United States Patent [19]

Landau

[11] 3,955,717

[45] May 11, 1976

[54] METHODS AND APPARATUS FOR FLOWING ARCHABLE MATERIALS

[76] Inventor: Richard E. Landau, 717 Cornwell Ave., West Hempstead, N.Y. 11552

[22] Filed: Aug. 16, 1971

[21] Appl. No.: 171,944

Related U.S. Application Data

[63] Continuation-in-part of Ser. No. 848,113, Aug. 6, 1969, which is a continuation-in-part of Ser. No. 616,753, Feb. 13, 1967.

[52] U.S. Cl. ..... 222/195

[51] Int. Cl.[2] ..... B65G 3/12

[58] Field of Search ..... 222/1, 195, 190, 394; 259/4, DIG. 17; 61/35

[56] References Cited

UNITED STATES PATENTS

| | | | |
|---|---|---|---|
| 2,331,208 | 10/1943 | Ludi | 222/195 X |
| 2,527,466 | 10/1950 | Townsend et al. | 222/195 UX |
| 3,052,384 | 9/1962 | Clark | 222/450 |
| 3,090,593 | 5/1963 | Pro | 222/450 X |
| 3,094,249 | 6/1963 | Pullen | 222/193 |
| 3,121,593 | 2/1964 | McIlvaine | 222/193 X |
| 3,125,256 | 3/1964 | Kokeisl | 222/195 |
| 3,366,282 | 1/1968 | Lucas | 222/195 |
| 3,415,450 | 12/1968 | Hawk, Jr. | 222/193 X |
| 3,578,216 | 5/1971 | Pearson | 222/195 |
| 3,608,317 | 9/1971 | Landau | 61/35 |
| 3,619,011 | 11/1971 | Doble | 222/193 |
| 3,647,188 | 3/1972 | Solt | 259/DIG. 17 |

FOREIGN PATENTS OR APPLICATIONS

| | | | |
|---|---|---|---|
| 703,043 | 2/1965 | Canada | 259/DIG. 17 |

*Primary Examiner*—Robert B. Reeves
*Assistant Examiner*—Norman L. Stack, Jr.

[57] ABSTRACT

Fluid jetting techniques are applied to the prevention of arches and plugs in archable materials which are flowed through containers and conduits. The fluid jetting technique involves the separation of particles in a manner which will minimize the development of forces between particles, so as to avoid the keying action necessary to arch formation which impedes flow of such materials. The applied fluid forms at least part of the medium within which the particles are maintained; however, the ultimate direction of flow of the material need not be limited to the direction of flow of the applied fluid. Outside forces may also be applied to the particles, such as gravity, which may affect the direction of flow resulting. The direction of application of the fluid jetting system is best when it is aimed at the location of arching to insure the breakdown of the arch as it may form; however, it is also beneficial to direct the fluid jet substantially in the direction of the desired flow of material from the system. Where the point or area of arch formation is at more than one probable location, more than one jet may be applied to insure continuity of flow. More than one type of fluid can be utilized in the jetting system, where specific chemical reactions are desired, or where a specific mixture of the flowed material and jetting fluid is necessary at the point of placement. Apparatus to effect the flow of material by jetting techniques involves the development of a chamber which will maintain sufficient fluid pressure so as to insure that the flow of material occurs in the desired direction. A portal, or means for introducing the material to be flowed, is provided as are the means for maintaining the system tight to permit the proper action of the jetting fluid. Means may also be provided for rotating the apparatus, should such be a requirement.

4 Claims, 2 Drawing Figures

Inventor

Richard E. Landa

By

Attorney

METHODS AND APPARATUS FOR FLOWING ARCHABLE MATERIALS

This is a continuation-in-part of U.S. Pat. application Ser. No. 848,113 filed Aug. 6, 1969, titled "Formation and Backfill of Cavities in Soil by Jetting," which is a continuation-in-part of U.S. Patent application Ser. No. 616,753 filed Feb. 13, 1967, titled "Formation and Backfill of Cavities in Soil by Jetting."

The present invention relates to method and equipment to flow archable material from containers or through conduits by jetting means. The method and equipment can be applied to the filling of cavities in soil, as well as to the more general conveying of material through confined channels such as conduits. The method involves employing a jet of fluid in a manner so as to disperse the material to be flowed, to minimize contact forces between particles while the particles are flowed within the fluid itself operating at least in part as the carrying medium. The equipment is best operated as a substantially closed system open only at the outlet end during the flowing process, with the jetting of fluid effected at the portion of the system where the material to be flowed is introduced into the conduit as well as at other points where arching of the material may occur.

The flow of archable materials is involved in many areas of construction and industry. Grain stored in silos is often caused to flow for shipping purposes simply by using the force of gravity. Damp materials, such as sand used in concrete and asphalt batching plants, tend to arch and it is necessary to provide special means, such as vibrators, to insure continuous material flow. In the installation of sand drains, it is necessary to backfill a cavity formed in soil with sand. To avoid the collapse of the cavity during the filling process, and to insure complete filling of the cavity, the sand must be flowed in a continuous manner and arching of the sand must be avoided. To effect the required flow of sand without arching often involves the use of fluid pressure, of on the order of 100 psi, to insure flow through a vertical pipe inserted into the cavity. The use of such high pressure often results in "blows," and increases in "pore" water pressure in wet soil, which is detrimental to the operation of the sand drain system. Saturated materials containing a major fraction of granular materials, such as concrete, are also known to form arches and plugs so as to impede its steady flow when being deposited in pipes to form cast-in-place concrete piling, and similar foundation support systems. In transporting granular materials horizontally, vertically, or at any desired incline, blower systems as well as vacuum systems are used, as are screw-type and other types of conveyors. All of the methods of flowing archable types of materials relate to physically overcoming the resistance effects of any arching or plugs that may form during the flow process, except for vibration. Although vibration utilizes a reversal of forces which has the effect of breaking arches or plugs, the vibratory force in itself does not exert a force involved in flowing the material in the desired direction.

It is at once evident that the most satisfactory means of flowing archable material involves a system which not only minimizes the possibility of forming arches in the material being flowed, but at the same time provide the impetus needed in maintaining the continuity of flow without obstructing the conduit or flow path. The present invention is a simpler and less costly method by which the desirable effects for flowing archable materials can be developed, without the limitations inherent to systems in use today. The present invention has the further advantage over any vibratory method in that the rigidity of the conduit in which the material is to be flowed bears no relation to the effectiveness of the method to prevent arching. This is in sharp contrast to the use of vibration which operates on the container rather than the material, where the more rigid the container or conduit, the greater the vibratory energy input to effect a breakdown of plugs and arches which may form in the material.

Figure 1:
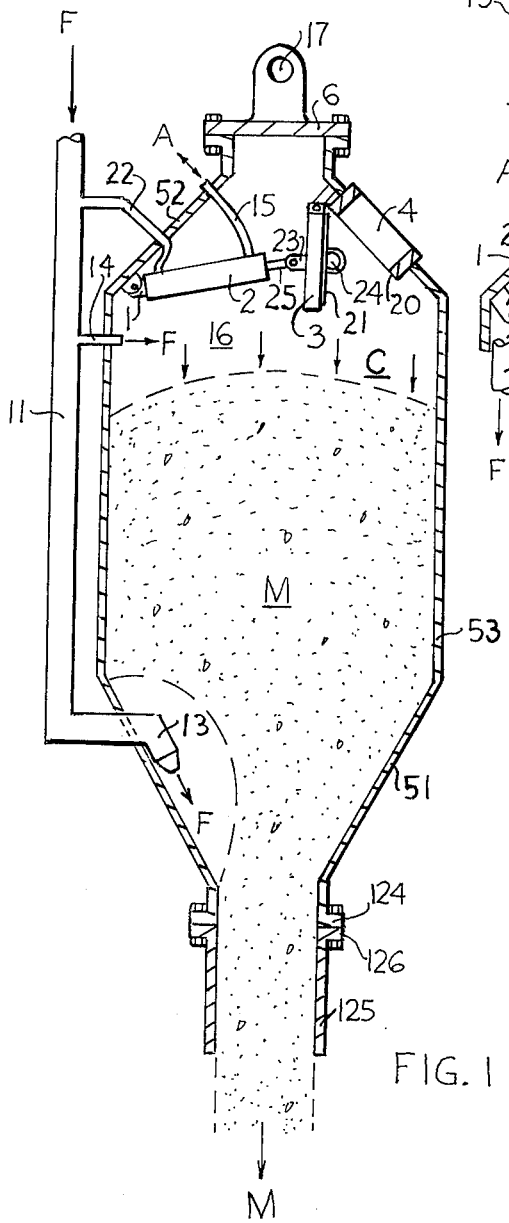
FIG. 1 shows a section through one form of the apparatus which may be used to practice the invention, which provides a means for filling the container holding material, M, to be flowed by the introduction of jetting fluid, F.

The illustrated apparatus consists of a container, C, into which the material, M is introduced into the system through which it is to be flowed. The point of entry of the material, M, into the system is through portal, 4, located in the upper tapered section 52. For the vertical arrangement of the apparatus, the material comes to rest in the container having a lower tapered section, 51, and a straight sided section 53. It is to be understood that many possible shapes exist that will satisfy the proper operation of the apparatus, including cylindrical, as well as angular shapes, with and without tapered end sections. It is also possible that the container be nothing more than a section of the conduit through which the material, M, is to be flowed. The apparatus of FIG. 1 is constructed with an outlet conduit, 125, which is connected through its flange, 126, to the flange, 124, of tapered section 51. The apparatus may be fixed in its vertical position and raised or lowered by hooking on at eye, 17, of upper flange connector, 6, located at the upper end of tapered section 52.

Where a substantially closed system is utilized, a fluid introduction pipe, 11, is so fitted as to actuate hydraulic cylinder, 2, through the partly flexible inlet pipe, 22, which causes piston, 25, to seat door, 3, at the lower edge, 20, of portal, 4. The relative movement of cylinder, 2, and door, 3, requires the presence of pivots 23 and 1 at the piston end and back end of the cylinder, 2, respectively. The outlet end of the cylinder, 2, exhausts to atmosphere. A through outlet pipe, 15, which is partly flexible. When necessary to form a fluid tight seal between the door, 3, and portal seat, 20, gasket, 21, may be placed on the bearing surface between the portal and the door.

The pipe, 11, provides fluid through jet, 13, which is appropriately positioned in the vicinity of the point of major arch formation. Although the jet, 13, directs fluid, F, into the material, M, in the general direction of desired flow, such is not indispensable as the fluid will tend to flow toward the outlet end of the system, 125, inasmuch as that is also the point of lowest pressure, which is always the factor in determining the direction of fluid flow. Not only will the introduction of fluid, F, at the level of arching break the arch, but it will also effect a separation of the particles comprising the arch. The use of a compressible fluid, will also maintain the particles separate by virtue of the fact that as the low pressure area is approached, the fluid, F, will tend to expand aiding particle separation. The application of fluid, F, to the upper surface of the material, M, at the interior, 16, of the upper portion of the container, C, assists in the positive flow of material, M, in the direction that is desired. Such secondary introduction of fluid, F, can be done through pipe, 14, which may also be connected to line, 11. It is noted that pipeline 11 need not connect to pipes 22 and 14 simultaneously with jetting nozzle 13. Each pipe can be fed separately, and more than one fluid can be used if desired. Mortar, or other chemicals, may be pumped through nozzle 13, and other jets, so as to mix with aggregate, M, to produce a desired concrete, or other chemical reactions, while air may be introduced through pipe 14 to assist in the flow of the mixture; and air or other fluid may be introduced through pipe 22 to effect a closing of the portal, 4, by the door, 3. It is noted that where it is not desired to utilize the hydraulic cylinder, 2, for door closure purposes, any other suitable door closing system may be employed. A second possibility involves connecting a rope or linkage to eye, 24, on door, 3, to physically pull the door closed to portal, 4. The portal is best sealed off in order to avoid a low pressure zone, which will dissipate the effect of the pressure of fluid, F, in causing flow in the desired direction through conduit, 125.

Figure 2:
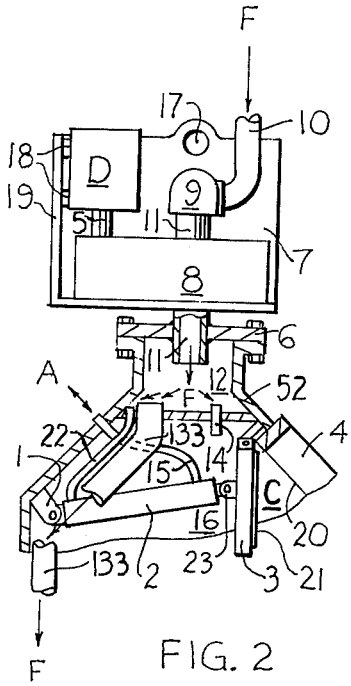
FIG. 2 shows a modification of the upper end of the apparatus in FIG. 1, which permits the apparatus to be rotated while flowing material, M, from the container through the lower end of the apparatus.

FIG. 2 illustrates an arrangement whereby Motor, D, operating through driveshaft, 5, operates gear box, 8, which rotates fluid inlet pipe, 11, connected to flange, 6, so as to rotate the apparatus. Fluid, F, is introduced into the system through pipe 10, passing through swivel, 9, and then through inlet pipe, 11, into plenum, 12. The fluid, F, in the plenum, 12, feeds fluid into the hydraulic cylinder, 2, through pipe, 22, and into the container, C, through pipe, 14. Fluid, F, is fed to the jet nozzle, 13, through pipe, 133. Where rotation of the container, C, is desired, a suitable drive system, D, can be supported either above or below the container, C. The system of FIG. 2, shows the condition where the drive system is above the container, C. A drive system mounted below the container, C, can be suitably adapted, such as between flanges 124 and 126, or else driven through a suitable connection piece, such as a chain sprocket, located at any desired position so as to effect the desired rotation of container, C. For the instance of FIG. 2, the drive mechanism, D, is supported on a frame, 7, which has a connection eye, 17, for fixing as well as raising and lowering the apparatus as may be desired while rotating the container, C. The drive system, D, is fixed to plate 19, through pads, 18, forming part of the frame, 7. The arrangement of FIG. 2, for simplicity, shows the use of a single fluid, F, and the feeding of material, M, into the container, C, most easily done while the apparatus is held stationary. In a closed type system, such as shown in FIG. 1, the apparatus may also function when inlet pipe 11 is inside the container, C, as shown in FIG. 2. In the latter instance, the arch prevention system may also function if nozzle 13, at the end of inlet pipe 133, is closed off, with fluid, F, entering into the upper end, 16, of container, C. In this instance, the fluid, F, will tend to flow to the lower outlet end of container, C, by virtue of the existing pressure differential, and the fluid will tend to follow the path of least resistance which will be at the physical juncture between the exterior of pipe 133 and sections 53 and 51 of container, C. In passing through this area, arches in the material, M, will be broken; and the fluid, F, in continuing its flow through section 51, will also break any arches existing below the lower end of nozzle 13.

In an open system, the door, 3, can be omitted, or other openings can be provided in the top, 16, of container, C. Such openings will enable upward flow of fluid from nozzle 13, which will break arches above the level of nozzle 13. By directly the jet nozzle, 13, downward, arches below nozzle, 13, can be broken down as well. The direction of nozzle orientation, and the location of openings will determine the ultimate direction of flow of material, M, as will the velocity of fluid developed in the apparatus. In the open system, gravitational force will have a greater influence on the ultimate direction of flow of material, M, than in a closed system.

It is to be noted that the flow of archable material can be effected while the apparatus is stationary, while it is moved axially, and while the apparatus is rotated, all being dependent upon the arrangement and design of the equipment to practice the method disclosed herein. It is noted that additional points of fluid introduction for arch prevention purposes may be provided at various levels within the container, 16, as well as at various points within the conduit 125, through which flow of material, M, is effected. For the vertical arrangement of the apparatus, gravitational forces also assist in the flow of material, M, as arch and plug formation is avoided. The volume of fluid, F, and the pressure required to prevent arching and to induce the flow of material, M, will vary with the type of material involved and its moisture content. Whereas 100 psi pressure is often used in flowing sand by other systems, under the present invention flow has been effected with pressures of only 40 psi and less.

Although certain particular embodiments of the invention are herein disclosed for purposes of explanation, further modifications thereof, after study of the specification and drawings, will be apparent to those skilled in the art to which the invention pertains. Reference should accordingly be had to the appended claims in determining the scope of the invention.

What is claimed and desired to be secured by Letters Patent is:

1. A method of dispensing flowable granular material by gravity from a vertically oriented hopper selectively closed and dispensing said material through an outlet comprising: supplying the hopper with granular material through a selectively closed passage in the hopper; injecting compressible fluid under pressure into the material at a point in the area of the tapered outlet; injecting said fluid under pressure in a direction in the area of the tapered outlet so that the entry of said fluid into the hopper does not exert pressure to obstruct gravity flow of said material; dispersing said compressible fluid as said fluid expands throughout the granular material so that a free fluid state is induced in the granular material to aid dispensing; providing sufficient fluid during dispensing operation to cause a pocket of fluid to form about said fluid inlet to promote dispersion of said fluid throughout said granular material, and providing a slight overpressure on top of the material by reason of said fluid escaping through the top of said granular material within said hopper.

2. The method of claim 1 wherein at least a portion of said fluid applied to provide overpressure is introduced from a point located above the upper surface of said material, with the hopper selected to be closed to maintain said overpressure to aid in directing material flow from the outlet of said hopper.

3. The method of claim 1 wherein at least a portion of said fluid is introduced to the vicinity of the hopper outlet section through the interior of a pipe mounted with said hopper.

4. The method of claaim 2 wherein at least a portion of fluid introduced above the upper surfaces of said material passes to levels below the top of said material through a path formed between the outer surface of a member mounted within said hopper and the adjacent interior wall of said hopper in a manner to at least aid in dispensing said flowable granular material.

* * * * *